US011021008B2

(12) United States Patent
Zhang

(10) Patent No.: US 11,021,008 B2
(45) Date of Patent: Jun. 1, 2021

(54) DRIVE MECHANISM FOR TRANSPOSITION AND STIRRING BY SINGLE DISC SINGLE MOTOR

(71) Applicant: ZHENGZHOU SANHUA TECHNOLOGY & INDUSTRY CO., LTD., Henan (CN)

(72) Inventor: Kunkun Zhang, Henan (CN)

(73) Assignee: ZHENGZHOU SANHUA TECHNOLOGY & INDUSTRY CO., LTD., Henan (CN)

( * ) Notice: Subject to any disclaimer, the term of this patent is extended or adjusted under 35 U.S.C. 154(b) by 263 days.

(21) Appl. No.: 16/106,732

(22) Filed: Aug. 21, 2018

(65) Prior Publication Data

US 2019/0054762 A1 Feb. 21, 2019

(30) Foreign Application Priority Data

Aug. 21, 2017 (CN) ..... 201710717586.7

(51) Int. Cl.

| | |
|---|---|
| ***B44D 3/00*** | (2006.01) |
| ***B01F 7/00*** | (2006.01) |
| ***B44D 3/08*** | (2006.01) |
| ***B01F 7/16*** | (2006.01) |
| ***B01F 15/00*** | (2006.01) |
| ***B01F 13/10*** | (2006.01) |
| *B01F 3/00* | (2006.01) |

(52) U.S. Cl.

CPC ..... *B44D 3/08* (2013.01); *B01F 7/1695* (2013.01); *B01F 13/1058* (2013.01); *B01F 15/00448* (2013.01); *B44D 3/003* (2013.01); *B01F 2003/0028* (2013.01); *B01F 2015/00623* (2013.01)

(58) Field of Classification Search

CPC ..... B01F 2015/00623; B01F 7/1695; B01F 13/1058; B01F 15/00448; B01F 2003/0028; B44D 3/08; B44D 3/003

See application file for complete search history.

(56) References Cited

U.S. PATENT DOCUMENTS 6,364,226 B1 * 4/2002 Kubicko ..... A47J 43/06 241/282.1
2004/0159727 A1 * 8/2004 Mueller ..... A47J 43/1068 241/169.1

FOREIGN PATENT DOCUMENTS

CN 2454154 Y 10/2001

* cited by examiner

*Primary Examiner* — Anshu Bhatia

(74) *Attorney, Agent, or Firm* — Hamre, Schumann, Mueller & Larson, P.C.

(57) ABSTRACT

A drive mechanism for transposition and stirring by single disc single motor includes a rotating transposition disc, wherein the transposition disc is a single-layer transposition disc, at least one gear set in which a gear ring is engaged with a planetary gear is arranged successively from inside to outside with the rotating shaft of the single-layer transposition disc as the center, the gear ring of each gear set is fixed on a rack, and the planetary gear engaged with the gear ring is rotationally installed on the transposition disc to serve as a driving gear of a stirring shaft of a color matching paint bucket. By adoption of the above technical solution, the present invention has the following beneficial effects: the structure is reasonable, the parts and components of the color mixing machine are reduced without reducing and decreasing the functions of the color mixing machine.

6 Claims, 5 Drawing Sheets

DRIVE MECHANISM FOR TRANSPOSITION AND STIRRING BY SINGLE DISC SINGLE MOTOR

FIELD OF THE INVENTION

The present invention belongs to the technical field of full-automatic color mixing machines, and particularly relates to a drive mechanism for transposition and stirring by single disc single motor.

BACKGROUND OF THE INVENTION

A color mixing machine is a color matching device for preparing paints (especially latex paints) and coating of a desired color. A quantitative extraction device on the color mixing machine is used for extracting particular color paste placed in a certain color matching paint bucket on the color mixing machine for matching with a selected amount of base paint to obtain the desired paint color and paint amount. A color mixing machine with a transposition disc, particularly a color mixing machine for color mixing of latex paint is currently used on the market. The utility model patent with a patent number CN00232543.8 adopts a double-layer transposition plate, which includes a transposition disc and a driving disc arranged on the transposition disc and driven by an eccentric transmission shaft, and a plurality of insertion holes matched with an Z-shaped driving rod at the bottom of a color matching paint bucket are distributed on the periphery of the driving disc, wherein the transposition disc is formed by buckling upper and lower transposition discs, the driving disc is located between the upper and lower transposition discs, corresponding open pores are formed in the upper transposition disc corresponding to the positions of the insertion holes, so that the insertion holes are combined with the Z-shaped driving rod in the color matching paint bucket, the upper and lower transposition discs are fixed by a connecting and locating member, in use, the lower transposition disc is supported on an upper surface of a power box through a roller support, the roller support can be composed of a plurality of balls installed on the upper surface of the power box, or can be composed of a plurality of balls installed on a bottom surface of the lower transposition disc, the roller support can also be composed of a plurality of rollers arranged between the upper surface of the power box and the lower transposition disc, when the double-layer transposition discs form the color mixing machine with a power device and the color matching paint bucket, the lower transposition disc is fixed on the power box, a transposition disc fixing shaft pin is arranged between the two components, a hole is formed in the center of the lower transposition disc, a power output shaft is combined with the lower shaft end of the eccentric transmission shaft through the center hole, the center of the driving disc is fastened to and combined with the upper shaft end of the eccentric transmission shaft, the insertion holes on the periphery of the driving disc are matched with the Z-shaped driving rod of the color matching paint bucket, when a motor drives the power output shaft to rotate, the eccentric transmission shaft rotates accordingly, so that the driving disc fixed on the upper shaft end of the eccentric transmission shaft translates in a certain area, and the Z-shaped driving rod inserted in the insertion holes on the periphery of the driving disc performs circular motion so as to stir the color paints in the color matching paint bucket.

Therefore, in order to realize the rotation of the transposition discs of the color mixing machine and the mixing of the pigments in the color matching paint bucket, multiple parts and components are required to cooperatively work, the more the parts and components are, the more the cooperation among the parts and components are, such that the failure rate of the cooperation among the parts and components is increased, and meanwhile, the production cost of the machine is also increased. In the international competition, the price advantage of products is very obvious for occupying the market, how to reduce the production costs of products is very important, it is very difficult to determine to reduce the costs of which parts and components, therefore, how to reduce the parts and components of the color mixing machine to reduce the production cost without reducing and decreasing the functions of the color mixing machine becomes the technical problems to be solved urgently at present.

SUMMARY OF THE INVENTION

In view of the above-mentioned shortcomings of the prior art, the present invention provides a drive mechanism for transposition and stirring by single disc single motor, wherein a forward and reverse rotation gear motor drives a transposition disc into forward or reverse rotation, when the transposition disc rotates, and by means of the cooperative transmission of a gear ring, a planetary gear and a gear ring, the planetary gear drives stirring blades in a color matching paint bucket to rotate, thereby achieving the rotation of the color matching paint bucket and the rotation of the stirring blades in the color matching paint bucket.

In order to solve the above technical problems, the technical solution adopted by the present invention is as follows:

A drive mechanism for transposition and stirring by single disc single motor includes a rotating transposition disc, the transposition disc is a single-layer transposition disc, at least one gear set in which a gear ring is engaged with a planetary gear is arranged successively from inside to outside with the rotating shaft of the single-layer transposition disc as the center, the gear ring of each gear set is fixed on a rack, and the planetary gear engaged with the gear ring is rotationally installed on the transposition disc to serve as a driving gear of a stirring shaft of a color matching paint bucket.

The gear ring is an inner gear ring or an outer gear ring.

A one-way rotating component is arranged between the stirring shaft of the color matching paint bucket and the planetary gear.

A power device is arranged on the rack to drive the single-layer transposition disc, and the power device is a forward and reverse rotation gear motor.

The single-layer transposition disc is of a circular structure.

The one-way rotating component is a one-way bearing, ratchet wheel or overrun clutch.

By adoption of the above technical solution, the present invention has the following beneficial effects: the structure is reasonable, the parts and components of the color mixing machine are reduced without reducing and decreasing the functions of the color mixing machine, so that the failure rate and the production cost of the color mixing machine are greatly reduced.

Figure 1:
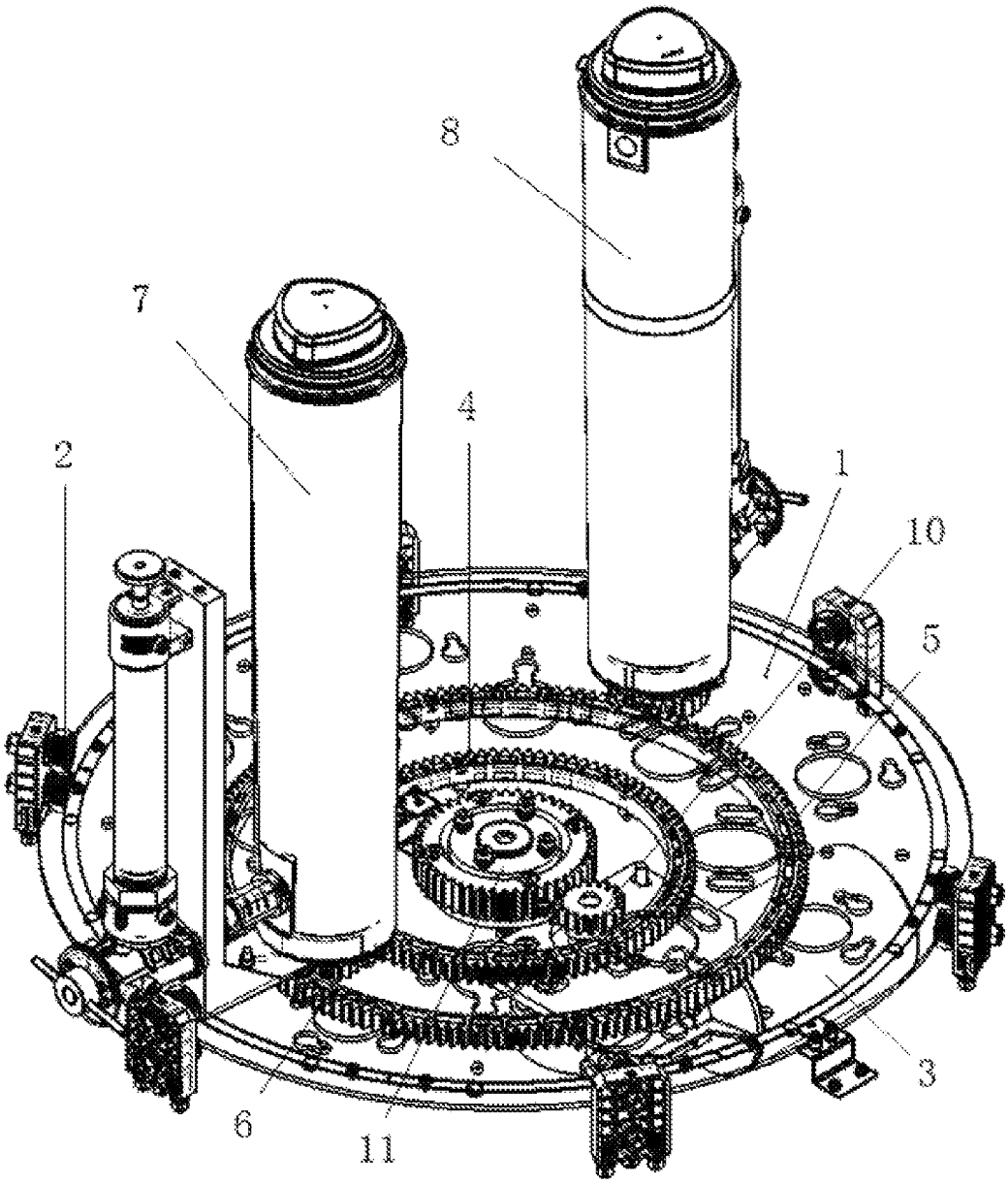
FIG. 1 is a schematic diagram of a three-dimensional structure of the present invention.
Figure 2:
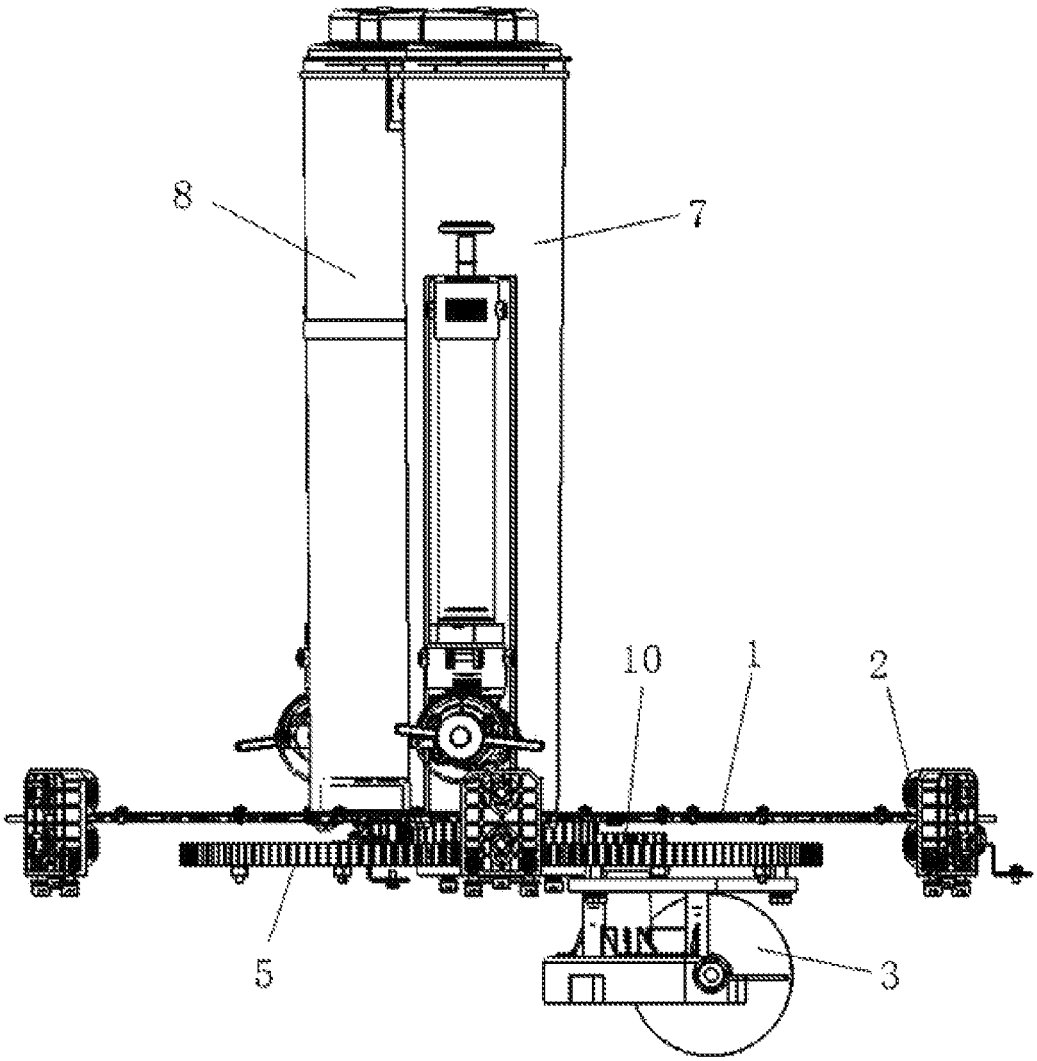
FIG. 2 is a schematic diagram of a front view structure of the present invention.
Figure 3:
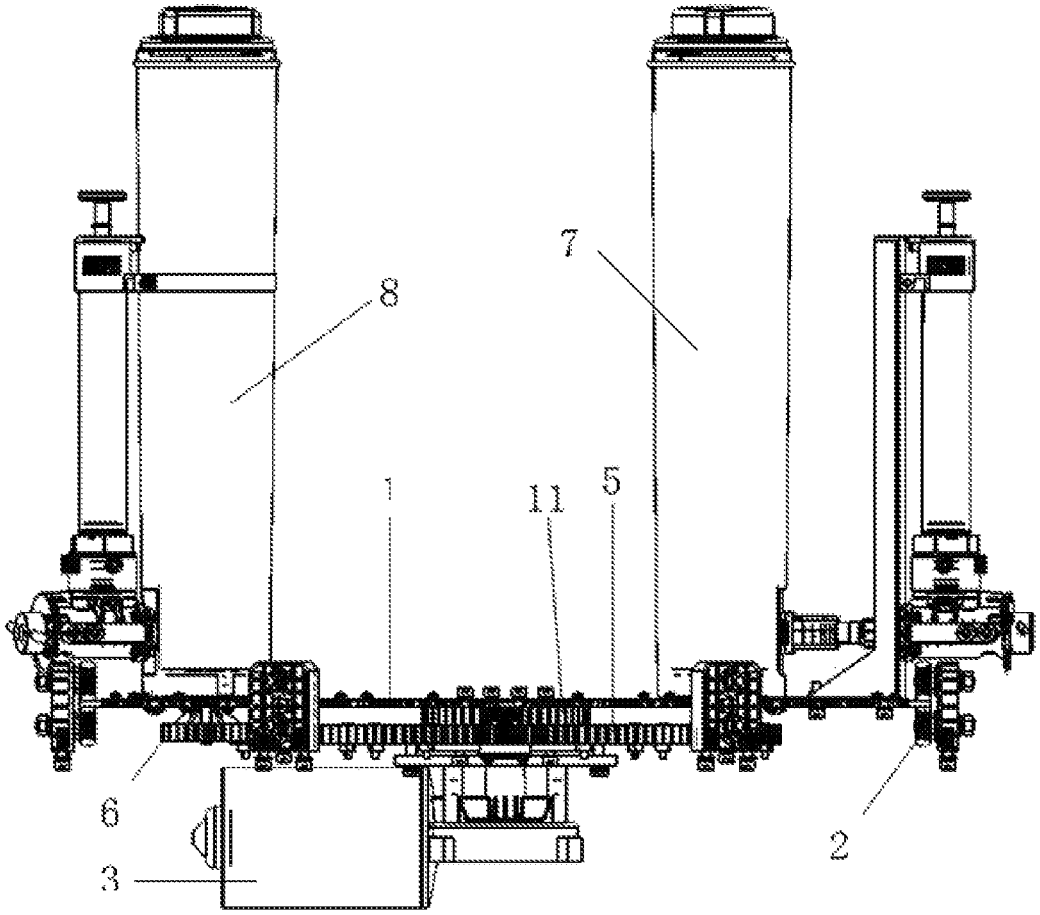
FIG. 3 is a schematic diagram of a left view structure of FIG. 1.
Figure 4:
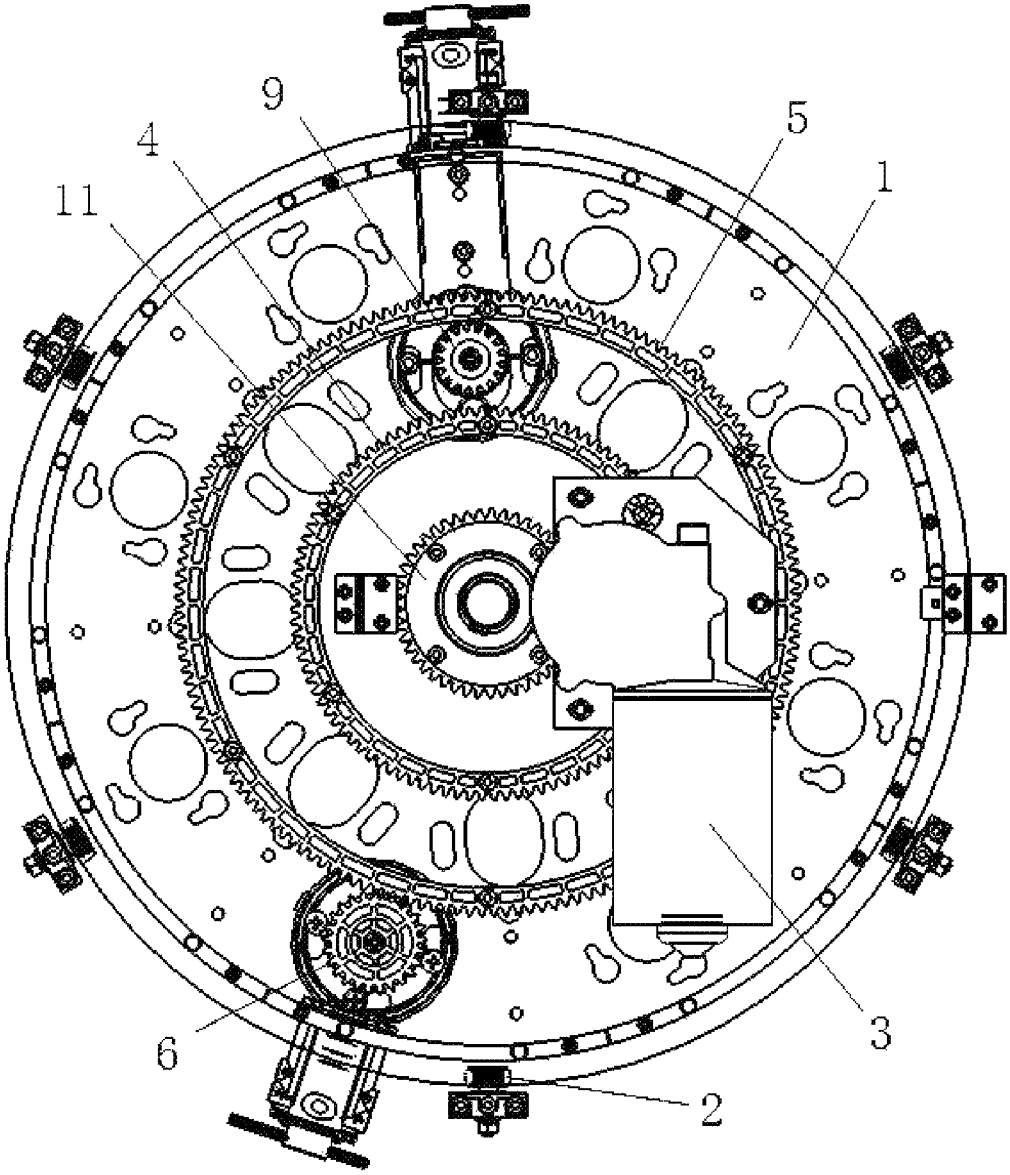
FIG. 4 is a schematic diagram of a bottom view structure of FIG. 1.

Reference signs: single-layer transposition disc 1, roller 2, forward and reverse rotation gear motor 3, inner gear ring 4, outer gear ring 5, planetary gear 6, inner ring color matching paint bucket 7, outer ring color matching paint bucket 8, one-way bearing 9, driving planetary gear 10, sun gear 11.

DETAILED DESCRIPTION OF THE EMBODIMENTS

The specific embodiments of the present invention are further described in detail below with reference to the accompanying drawings:

As shown in FIGS. 1 to 4, a drive mechanism for transposition and stirring by single disc single motor includes a rotating transposition disc, the transposition disc is a single-layer transposition disc 1, at least one gear set in which a gear ring is engaged with a planetary gear is arranged successively from inside to outside with the rotating shaft of the single-layer transposition disc 1 as the center, two gear rings are provided and are respectively an inner gear ring 4 and an outer gear ring 5, the gear rings of each gear set is fixed on a rack, and the planetary gears engaged with the gear rings are rotationally installed on the transposition disc to serve as driving gears of a stirring shaft of a color matching paint bucket.

The gear ring is an inner gear ring, an outer gear ring or an inner and outer gear ring, the inner and outer gear ring can be matched with planetary gears on inner and outer rings at the same time, and the gear ring in the present invention is the outer gear ring. A one-way rotating component is arranged between the stirring shaft of the color matching paint bucket and the planetary gear.

A power device is arranged on the rack to drive the single-layer transposition disc, and the power device is a forward and reverse rotation gear motor.

The single-layer transposition disc is of a circular structure.

The one-way rotating component is a one-way bearing 9, a ratchet wheel or an overrun clutch, the one-way bearing 9 is adopted as the one-way rotating component in the present invention, and the one-way bearing 9 is simple in structure, durable and low in cost, thereby being suitable for large-scale assembly and production. The one-way bearings 9 are arranged between the stirring shafts of the color matching paint buckets and the planetary gears, the rotation directions of all one-way bearings 9 are consistent, the pulp or pigment in the color matching paint buckets needs to be stirred, but excessively stirring is not good for the pulp or pigment in the color matching paint buckets, when the stirring is required, the forward and reverse rotation gear motor 3 drives the single-layer transposition disc 1 to rotate along a direction, the color matching paint buckets rotate with the single-layer transposition disc 1, the planetary gear 6 on the inner ring color matching paint bucket 7 rotates around the inner gear ring 4, the one-way bearing 9 on the inner ring color matching paint bucket 7 is stressed to drive the stirring blades of the stirring shaft in the inner ring color matching paint bucket 7 to start stirring, the planetary gear 6 on the outer ring color matching paint bucket 8 rotates around the outer gear ring 5, the one-way bearing 9 on the outer ring color matching paint bucket 8 is stressed to drive the stirring blades of the stirring shaft in the outer ring color matching paint bucket 8 to start stirring, after the pulp or pigment in all color matching paint buckets is stirred, the forward and reverse rotation gear motor 3 drives the single-layer transposition disc 1 to rotate along a reverse direction, the color matching paint buckets rotate along the reverse direction with the single-layer transposition disc 1, at this time, the planetary gear 6 on the inner ring color matching paint bucket 7 rotates around the inner gear ring 4 along the reverse direction, the one-way bearing 9 on the inner ring color matching paint bucket 7 is not stressed, the stirring blades of the stirring shaft in the inner ring color matching paint bucket 7 stop stirring, meanwhile, the planetary gear 6 on the outer ring color matching paint bucket 8 rotates around the outer gear ring 5 along the reverse direction, the one-way bearing 9 on the outer ring color matching paint bucket 8 is not stressed, and the stirring blades of the stirring shaft in the outer ring color matching paint bucket 8 stop stirring.

The power device is the forward and reverse rotation gear motor 3, which can achieve forward and reverse rotation, saves the power, generates small working vibration, is reliable and durable, is high in overload capacity, and is able to withstand stronger radial load.

The working process of the present invention is as follows:

The one-way bearings 9 are arranged between the stirring shafts of the color matching paint buckets and the planetary gears, the rotation directions of all one-way bearings 9 are consistent, the pulp or pigment in the color matching paint buckets needs to be stirred, but excessively stirring is not good for the pulp or pigment in the color matching paint buckets, when the stirring is required, the forward and reverse rotation gear motor 3 drives the single-layer transposition disc 1 to rotate along a direction, the color matching paint buckets rotate with the single-layer transposition disc 1, the planetary gear 6 on the inner ring color matching paint bucket 7 rotates around the inner gear ring 4, the one-way bearing 9 on the inner ring color matching paint bucket 7 is stressed to drive the stirring blades of the stirring shaft in the inner ring color matching paint bucket 7 to start stirring, the planetary gear 6 on the outer ring color matching paint bucket 8 rotates around the outer gear ring 5, the one-way bearing 9 on the outer ring color matching paint bucket 8 is stressed to drive the stirring blades of the stirring shaft in the outer ring color matching paint bucket 8 to start stirring, after the pulp or pigment in all color matching paint buckets is stirred, the forward and reverse rotation gear motor 3 drives the single-layer transposition disc 1 to rotate along a reverse direction, the color matching paint buckets rotate along the reverse direction with the single-layer transposition disc 1, at this time, the planetary gear 6 on the inner ring color matching paint bucket 7 rotates around the inner gear ring 4 along the reverse direction, the one-way bearing 9 on the inner ring color matching paint bucket 7 is not stressed, the stirring blades of the stirring shaft in the inner ring color matching paint bucket 7 stop stirring, meanwhile, the planetary gear 6 on the outer ring color matching paint bucket 8 also rotates around the outer gear ring 5 along the reverse direction, the one-way bearing 9 on the outer ring color matching paint bucket 8 is not stressed, the stirring blades of the stirring shaft in the outer ring color matching paint bucket 8 stop stirring, and only the inner ring color matching paint bucket 7 and the outer ring color matching paint bucket 8 rotate with the single-layer transposition disc 1.

In embodiment 1, as shown in FIG. 1, the transposition disc 1 is driven by an eccentric motor, the forward and reverse rotation gear motor 3 is horizontally arranged on the rack, the spindle of the forward and reverse rotation gear motor 3 is in transmission with a vertical gear at the lower end part of the output shaft, a driving planetary gear 10 is arranged at the upper end of the output shaft, a sun gear 11 is arranged at the center of the transposition disc 1, and the driving planetary gear 10 is engaged with the sun gear 11 to drive the single-layer transposition disc 1 to perform forward rotation or reverse rotation.

Figure 5:
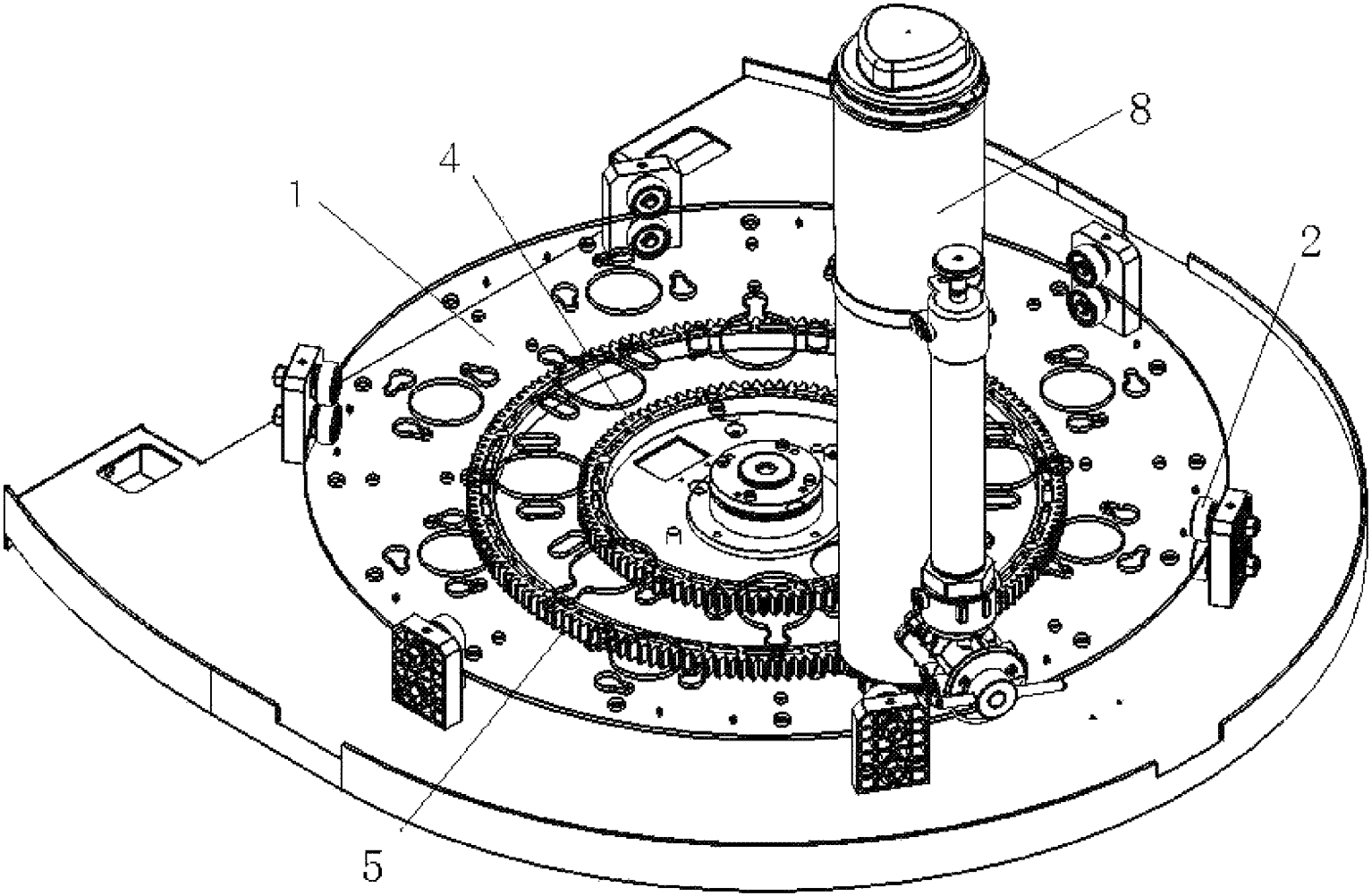
FIG. 5 is a schematic diagram of a three-dimensional structure of an embodiment 2 of the present invention.

In embodiment 2, as shown in FIG. 5, the transposition disc 1 is driven by a central motor, the forward and reverse rotation gear motor 3 is horizontally arranged on the rack, the spindle of the forward and reverse rotation gear motor 3 is in transmission with a vertical gear at the lower end part of the output shaft, the upper end of the output shaft is fixedly connected with the center of the transposition disc 1, the spindle of the forward and reverse rotation gear motor 3 drives the output shaft to rotate, and the output shaft drives the single-layer transposition disc 1 to perform forward rotation or reverse rotation.

The shape, material, structure and the like present invention are not limited to any form in the present embodiment, and any simple modifications, equivalent changes and modifications of the above embodiments made according to the technical essence of the present invention all belong to the protection scope of the technical solution of the present invention.

The invention claimed is:

1. A drive mechanism for transposition and stirring by single disc single motor, comprising:

a rotating transposition disc, the transposition disc being a single-layer transposition disc having a rotating shaft;

at least one gear set in which a gear ring is engaged with a planetary gear and is arranged successively from inside to outside with the rotating shaft of the single-layer transposition disc as the center, the gear ring of each gear set is fixed on a rack, and the planetary gear engaged with the gear ring is rotationally installed on the transposition disc to serve as a driving gear of a stirring shaft of a color matching paint bucket; and a one-way rotating component is arranged between the stirring shaft of the color matching paint bucket and the planetary gear.

2. The drive mechanism for transposition and stirring by single disc single motor according to claim 1, wherein the gear ring is an inner gear ring or an outer gear ring or an inner and outer gear ring.

3. The drive mechanism for transposition and stirring by single disc single motor according to claim 2, wherein a power device is arranged on the rack to drive the single-layer transposition disc, and the power device is a forward and reverse rotation gear motor.

4. The drive mechanism for transposition and stirring by single disc single motor according to claim 3, wherein the single-layer transposition disc has a circular structure.

5. The drive mechanism for transposition and stirring by single disc single motor according to claim 1, wherein the one-way rotating component is a one-way bearing, ratchet wheel or overrun clutch.

6. A drive mechanism for transposition and stirring by single disc single motor, comprising:

a rotating transposition disc, the rotating transposition disc being a single-layer transposition disc having a rotating shaft;

at least one gear set in which a gear ring is engaged with a planetary gear is arranged successively from inside to outside with the rotating shaft of the single-layer transposition disc as the center, the gear ring of each gear set is fixed on a rack, and the planetary gear engaged with the gear ring is rotationally installed on the transposition disc to serve as a driving gear of a stirring shaft of a color matching paint bucket; and a one-way rotating component is arranged between the stirring shaft of the color matching paint bucket and the planetary gear, the one-way rotating component being a one-way bearing, ratchet wheel or overrun clutch, wherein the gear ring is an inner gear ring or an outer gear ring or an inner and outer gear ring, a power device is arranged on the rack to drive the single-layer transposition disc, and the power device is a forward and reverse rotation gear motor, and the single-layer transposition disc is of a circular structure.

* * * * *